US006790128B1

(12) United States Patent
Taylor et al.

(10) Patent No.: US 6,790,128 B1
(45) Date of Patent: Sep. 14, 2004

(54) FLUID CONSERVING PLATEN FOR OPTIMIZING EDGE POLISHING

(75) Inventors: Travis Robert Taylor, Fremont, CA (US); Cangshan Xu, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 46 days.

(21) Appl. No.: 10/112,424

(22) Filed: Mar. 29, 2002

(51) Int. Cl.[7] ..... B24B 1/00
(52) U.S. Cl. ..... 451/41; 451/54; 451/307
(58) Field of Search ..... 451/41, 54, 59, 451/63, 303, 296, 307

(56) References Cited

U.S. PATENT DOCUMENTS

| | | | |
|---|---|---|---|
| 5,558,568 | A | 9/1996 | Talieh et al. |
| 5,692,947 | A | 12/1997 | Talieh et al. |
| 5,722,877 | A | 3/1998 | Meyer et al. |
| 5,800,248 | A | 9/1998 | Pant et al. |
| 5,916,012 | A | 6/1999 | Pant et al. |
| 6,155,915 | A | 12/2000 | Raeder |

FOREIGN PATENT DOCUMENTS

| | | | |
|---|---|---|---|
| EP | 0 706 857 | A | 4/1996 |
| EP | 0 914 906 | A | 5/1999 |
| WO | WO 00 25982 | A | 5/2000 |

*Primary Examiner*—Eileen P. Morgan
(74) *Attorney, Agent, or Firm*—Martine & Penilla, LLP

(57) ABSTRACT

A platen is disclosed. The platen includes a support surface for supporting a portion of a linear polishing belt during a chemical mechanical polishing (CMP) operation. The platen also includes a plurality of fluid outlets oriented throughout the support surface. The orientation defines an asymmetric pattern where each of the plurality of fluid outlets is capable of outputting a controlled fluid toward an underside of the linear polishing belt.

21 Claims, 6 Drawing Sheets

FLUID CONSERVING PLATEN FOR OPTIMIZING EDGE POLISHING

BACKGROUND OF THE INVENTION

1. Field of the Invention

This invention relates generally to chemical mechanical planarization apparatuses, and more particularly to methods and apparatuses for improved uniformity in chemical mechanical planarization applications via asymmetric platen pressure zones.

2. Description of the Related Art

In the fabrication of semiconductor devices, there is a need to perform chemical mechanical planarization (CMP) operations. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the variations in the surface topography. In other applications, metallization line patterns are formed in the dielectric material, and then, metal CMP operations are performed to remove excess material.

A chemical mechanical planarization (CMP) system is typically utilized to polish a wafer as described above. A CMP system typically includes system components for handling and polishing the surface of a wafer. Such components can be, for example, an orbital polishing pad, or a linear belt polishing pad. The pad itself is typically made of a polyurethane material or polyurethane in conjunction with other materials such as, for example a stainless steel belt. In operation, the belt pad is put in motion and then a slurry material is applied and spread over the surface of the belt pad. Once the belt pad having slurry on it is moving at a desired rate, the wafer is lowered onto the surface of the belt pad. In this manner, wafer surface that is desired to be planarized is substantially smoothed, much like sandpaper may be used to sand wood. The wafer may then be cleaned in a wafer cleaning system.

FIG. 1A shows a linear polishing apparatus 10 which is typically utilized in a CMP system. The linear polishing apparatus 10 polishes away materials on a surface of a semiconductor wafer 16. The material being removed may be a substrate material of the wafer 16 or one or more layers formed on the wafer 16. Such a layer typically includes one or more of any type of material formed or present during a CMP process such as, for example, dielectric materials, silicon nitride, metals (e.g., aluminum and copper), metal alloys, semiconductor materials, etc. Typically, CMP may be utilized to polish the one or more of the layers on the wafer 16 to planarize a surface layer of the wafer 16.

The linear polishing apparatus 10 utilizes a polishing belt 12, which moves linearly with respect to the surface of the wafer 16. The belt 12 is a continuous belt rotating about rollers (or spindles) 20. A motor typically drives the rollers so that the rotational motion of the rollers 20 causes the polishing belt 12 to be driven in a linear motion 22 with respect to the wafer 16.

A wafer carrier 18 holds the wafer 16. The wafer 16 is typically held in position by mechanical retaining ring and/or by vacuum. The wafer carrier positions the wafer atop the polishing belt 12 so that the surface of the wafer 16 comes in contact with a polishing surface of the polishing belt 12.

FIG. 1B shows a side view of the linear polishing apparatus 10. As discussed above in reference to FIG. 1A, the wafer carrier 18 holds the wafer 16 in position over the polishing belt 12 while applying pressure to the polishing belt. The polishing belt 12 is a continuous belt typically made up of a polymer material such as, for example, the IC 1000 made by Rodel, Inc. layered upon a supporting layer. The polishing belt 12 is rotated by the rollers 20 which drives the polishing belt in the linear motion 22 with respect to the wafer 16. In one example, a fluid bearing platen 24 supports a section of the polishing belt under the region where the wafer 16 is applied. The platen 24 can then be used to apply fluid against the under surface of the supporting layer. The applied fluid thus forms a fluid bearing that creates a polishing pressure on the underside of the polishing belt 12 which is applied against the surface of the wafer 16. Unfortunately, because the polishing pressure produced by the fluid bearing typically cannot be controlled very well, the polishing pressure applied by the fluid bearing to different parts of the wafer 16 generally is non-uniform. Generally, uniformity requires all parameters defining the material removal rate to be evenly distributed across the entire contact surface that interfaces with the wafer. Edge instabilities in CMP are among the most significant performance affecting issues and among the most complicated problems to resolve.

FIG. 1C shows a linear polishing apparatus 10 illustrating edge effect non-uniformity factors. In this example, a wafer 16 is attached to a carrier 18, which applies pressure 13 to push the wafer 16 down on the polishing belt 12 that is moving over the platen 24. However, the polishing belt 12 deforms when the wafer contacts the polishing belt 12. Although the polishing belt 12 is a compressible medium, the polishing belt 12 has limited flexibility, which prevents the polishing belt 12 from conforming to the exact shape of the wafer 16, forming transient deformation zones 22 and 26. As a result, edge effects occur at the wafer edge 16*a* and 16*b* from a non-flat contact field resulting from redistributed contact forces. Hence, large variations in removal rates occur at the wafer edge 16*a* and 16*b*. Consequently, due to the fact that the prior art polishing belt designs do not properly control polishing dynamics, uneven polishing and inconsistent wafer polishing may result thereby decreasing wafer yield and increasing wafer costs.

In addition to the aforementioned problem of non-uniform wafer polishing, typical air bearing platens utilize a very large amount of air to apply air pressure to the polishing belt. For example, in platens used for 200 mm wafer CMP operations, as much as 100 SCFM (Standard Cubic Feet per Minute) of air may be utilized, and in 300 mm wafer CMP operations as much as 200 SCFM of air may be used. As a result, a large source of air must be utilized to be able to provide sufficient air to create the air bearing. Consequently, prior art air bearing platens have a problem of large air consumption.

In view of the foregoing, there is a need for an apparatus that overcomes the problems of the prior art by having a platen that improves polishing pressure control and reduces polishing pad deformation and at the same time reduce fluid consumption during CMP operations.

SUMMARY OF THE INVENTION

Broadly speaking, embodiments of the present invention fill these needs by providing a platen design that provides edge polishing uniformity control during a CMP process utilizing a fluid conserving platen. It should be appreciated that the present invention can be implemented in numerous ways, including as a process; an apparatus, a system, a device, or a method. Several inventive embodiments of the present invention are described below.

In one embodiment, a platen is disclosed. The platen includes a support surface for supporting a portion of a linear polishing belt during a chemical mechanical polishing (CMP) operation. The platen also includes a plurality of fluid outlets oriented throughout the support surface. The orientation defines an asymmetric pattern where each of the plurality of fluid outlets is capable of outputting a controlled fluid toward an underside of the linear polishing belt.

In another embodiment, a method for wafer planarization using a linear chemical mechanical planarization (CMP) system is disclosed where the CMP system includes a platen with a front region, a rear region, a trailing region, and a fluid conservation region disposed below a polishing pad. The method includes applying fluid from at least one of the front region, the rear region, and the trailing region of the platen to an underside of the polishing pad to apply polishing pressure to at least one of a corresponding polishing zone. The method also includes restricting fluid output during wafer planarization by using the fluid conservation region to define an asymmetric fluid output from the platen. The polishing pressure to at least one of a front polishing zone, the rear polishing zone, and the trailing polishing zone induces a substantially uniform wafer polishing rate.

In yet another embodiment, a platen for use in a chemical mechanical planarization (CMP) system is disclosed. The platen includes a front region that has a plurality of fluid outlets. The front region is disposed below a polishing pad during CMP operation. The front region is capable of providing polishing pressure to the polishing pad at a front polishing zone. The platen also includes a rear region that has a plurality of fluid outlets. The rear region is disposed below the polishing pad during CMP operation. The rear region is capable of providing polishing pressure to the polishing pad at a rear polishing zone. The platen further includes a trailing region having a plurality of fluid outlets. The trailing region is disposed below the polishing pad during CMP operation. The trailing region is capable of providing polishing pressure to the polishing pad at a trailing polishing zone. The platen also includes a fluid conservation region. The platen is limited to supplying fluid from the plurality of fluid outlets of the front region, the rear region, and the trailing region to an underside of the polishing pad disposed above the platen to achieve a substantially uniform wafer polishing rate.

Because of the advantageous effects of applying controlled pressure to various areas of the wafer, embodiments of the present invention provide significant improvement in planarization while polishing in the area of pad deformities. In addition, the platen described herein includes a fluid conservation region which conserves usage of fluids by not applying fluid force to the polishing pad. Consequently, the platen may not only generate a substantially uniform polishing rate of wafers, but in addition, the platen will use significantly less fluid than prior art platens. Therefore, the platen described herein increases wafer production efficiency and decreases wafer production costs. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a platen design that provides edge polishing uniformity control during a CMP process utilizing asymmetric fluid pressure zones. The asymmetric fluid pressure zones over a platen are generated by having pressure generating regions as well as a fluid conservation region on the platen. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

In general, embodiments of the present invention provide a platen within a CMP system that has the unique ability to independently control polishing pressure on a trailing edge, a front edge, and a rear edge, allowing the wafer polishing to be more consistent and efficient. In one embodiment, a fluid conservation region is located in the leading edge region of the platen that does not apply fluid pressure to a polishing pad. As a result, polishing pressure differences and inconsistencies arising from poor polishing pad pressure dynamics may be compensated for in a highly manageable manner while conserving substantial amounts of fluid during a CMP operation.

A platen of the embodiments of the present invention may include any suitable number or configuration of pressure zones outside of the leading zone. Each pressure zone corresponds to a platen region with a plurality of fluid holes. The platen regions may be utilized to output fluid at different pressures thus compensating for polishing pad dynamics inadequacies. It should be understood that the embodiments of the present invention can be utilized for polishing any size wafer such as, for example, 200 mm wafers, 300 mm wafers.

A fluid as utilized herein may be any type of gas (e.g. clean dry air) or liquid (e.g. water). Preferably, clean dry air is utilized as the fluid. Therefore, fluid platens as described below may utilize gas or liquid to control pressure applied by a polishing pad to a wafer. In addition, embodiments of the present invention can implement mechanical devices to provide pressure to the polishing belt such as, for example, piezoelectric elements.

Figure 1A:
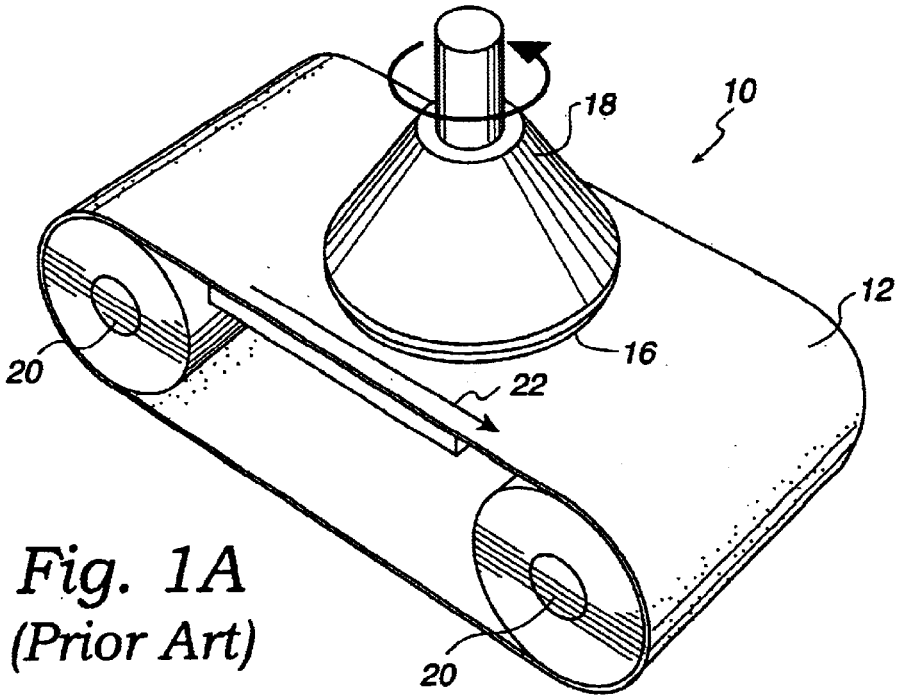
Fig. 1A (Prior Art)
FIG. 1A shows a linear polishing apparatus which is typically utilized in a CMP system.
Figure 1B:
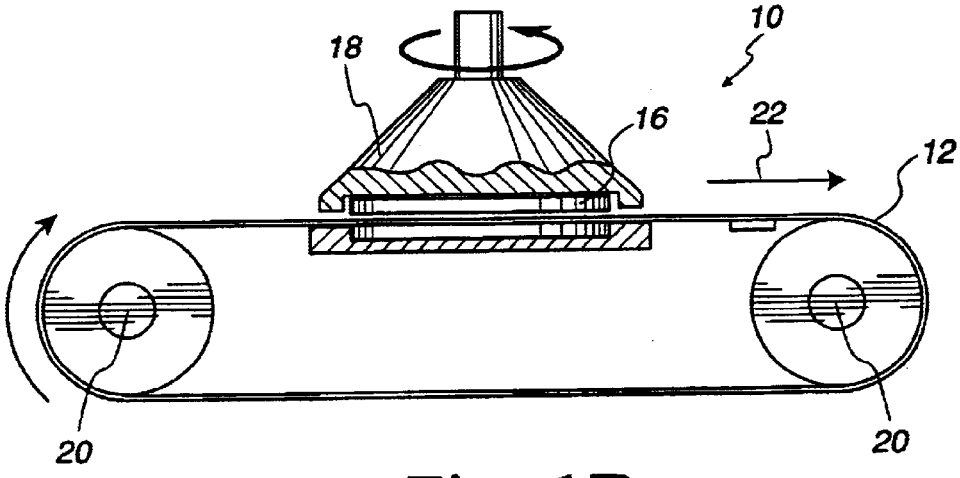
Fig. 1B (Prior Art)
FIG. 1B shows a side view of the linear polishing apparatus.
Figure 1C:
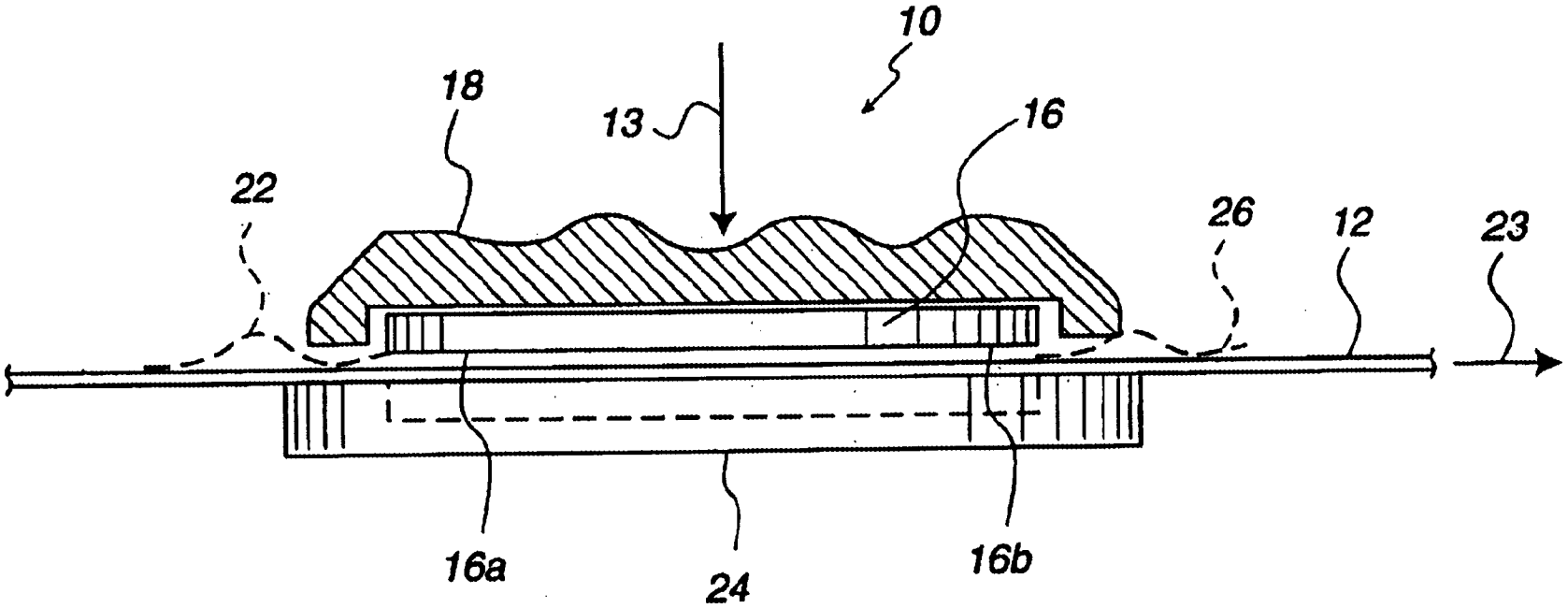
Fig. 1C (Prior Art)
FIG. 1C shows a linear polishing apparatus illustrating edge effect non-uniformity factors.
Figure 2:
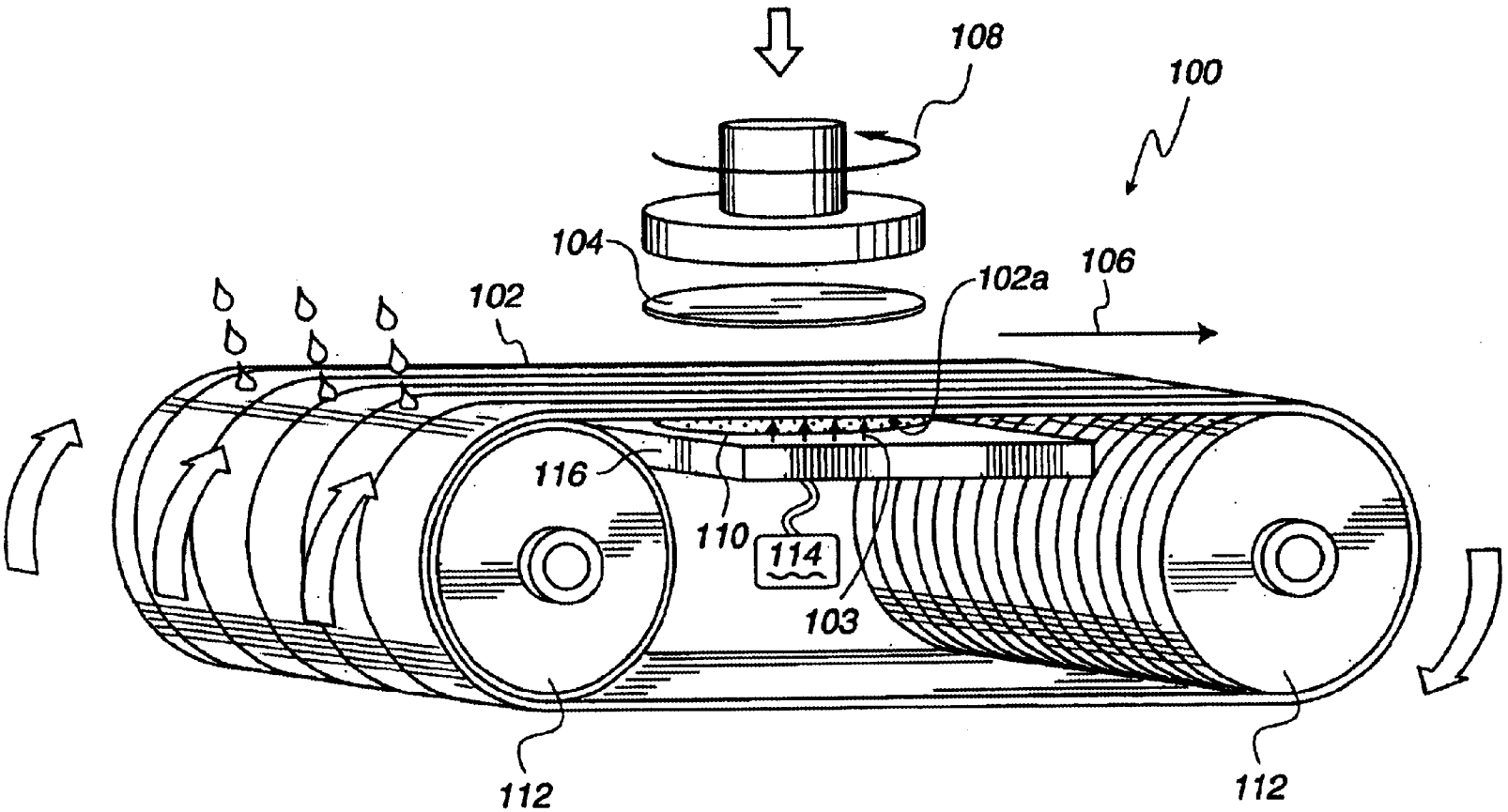
FIG. 2 shows a side view of a wafer linear polishing apparatus in accordance with one embodiment of the present invention.

FIG. 2 shows a side view of a wafer linear polishing apparatus 100 in accordance with one embodiment of the present invention. In this embodiment, a carrier head 108 may be used to secure and hold a wafer 104 in place during processing. A polishing pad 102 preferably forms a continuous loop around rotating drums 112. The polishing pad 102 generally moves in a direction 106 at a speed of about 400 feet per minute, however, it should be noted that this speed may vary depending upon the specific CMP operation. As the polishing pad 102 rotates, the carrier 108 may then be used to lower the wafer 104 onto a top surface of the polishing pad 102.

A platen 110 may support the polishing pad 102 during the polishing process. The platen 110 has a top surface that is also known as a support surface where a plurality of fluid outputs may be located. A platen surround plate 116 supports and holds the platen 110 in place. The platen 110 may utilize any type of bearing such as a liquid bearing or a gas bearing. Fluid pressure from a fluid source 114 outputted from the platen 110 by way of independently controlled pluralities of output holes may be utilized to provide upward force 103 to a polishing pad underside 102*a* to control the polishing pad profile. In one embodiment, the fluid source 114 may be a manifold managed by a controller. Such a manifold may control the fluid pressure applied to various regions of platen 110. In one exemplary embodiment, the fluid source 114 may be connected by tubes to the platen 110 where each of the tube(s) may correspond with a region of the platen where fluid is outputted. In this way, the number of tubes connecting to the platen 110 may correspond with the number of independently controlled fluid deliver regions on the platen 110. Independently controlled fluid outputs are outputs that may each output different flow rates of fluid depending on the polishing rate and the polishing rate profile desired. Therefore, the fluid source 114 may be utilized to apply any suitable pressure to different independently controllable regions of the platen 110 where fluid outputs exist. As described below in reference to FIGS. 3 through 5B, certain regions of the platen 110 may apply fluid pressure to the polishing pad 102 to reduce edge effect and other non-uniformity factors during CMP processing. At the same time, a fluid conserving region of the wafer 110 does not apply fluid pressure to the polishing pad 102 thereby reducing fluid usage.

Figure 3:
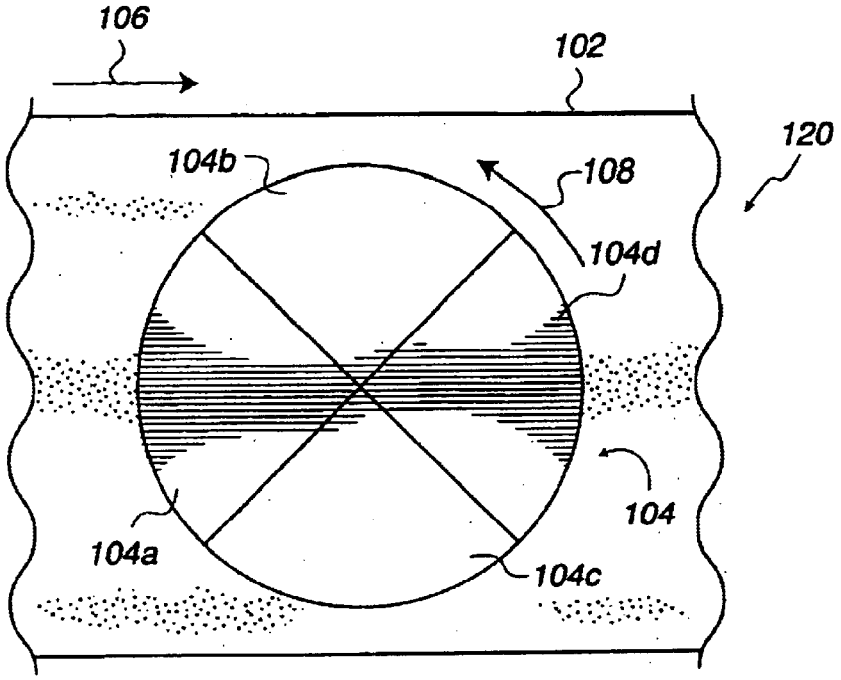
FIG. 3 shows a top view of a wafer linear polishing process as may be conducted by a linear polishing apparatus in accordance with one embodiment of the present invention.

FIG. 3 shows a top view of a wafer linear polishing process 120 as may be conducted by a linear polishing apparatus in accordance with an embodiment of the present invention. As described above with respect to FIG. 2, the polishing pad 102 moves in a direction 106 producing a friction which assists in the polishing process. The process 120 as shown in FIG. 3 illustrates that polishing occurs through the movement of the polishing pad 102 and the pressing down of the wafer 104 onto the polishing pad 102. The wafer 104 is typically spun in a direction 108 during the CMP process. In one embodiment, the wafer 104 may have four polishing zones that have different polishing characteristics.

The four distinct polishing zones shown in FIG. 3 are a leading zone 104*a*, a front zone 104*c* (also known as a front polishing zone), a rear zone 104*b* (also known as a rear polishing zone), and a trailing zone 104*d* (also known as a trailing polishing zone). The polishing zones 104*a*, 104*b*, 104*c*, and 104*d* correspond to quadrant regions of the wafer 104. The polishing zones 104*a*, 104*b*, 104*c*, and 104*d*, in one embodiment, together may have a larger circumference than wafer 104 due to polishing pressures exerted outside of the circumference of the wafer 104. Depending on how much fluid pressure is applied by the platen 110 to the polishing pad 102 that correspond to those zones, polishing rates in different zones 104*a*, 104*b*, 104*c*, and 104*d* of the wafer 104 may be managed.

The trailing zone 104*d* of the wafer 104 tends to have less polishing pressure due to variations in polishing pad deformations. The differences in polishing pressures on the leading zone 104*a* and the trailing zone 104*d* are significant. Therefore, through independent control of fluid pressure under the zones 104*b*, 104*c*, and 104*d*, the polishing pressure may be adjusted to provide optimal and consistent edge polishing pressures in the different pressure zones above the platen 110. By applying fluid pressure to zones of the wafer at other areas besides the leading zone, wafer polishing, especially at the wafer's edge, can be optimized. Consequently, embodiments of the present invention intelligently controls the polishing pressures on the wafer by applying fluid pressure to only non-leading edge zones to optimize the wafer polishing process.

Figure 4:
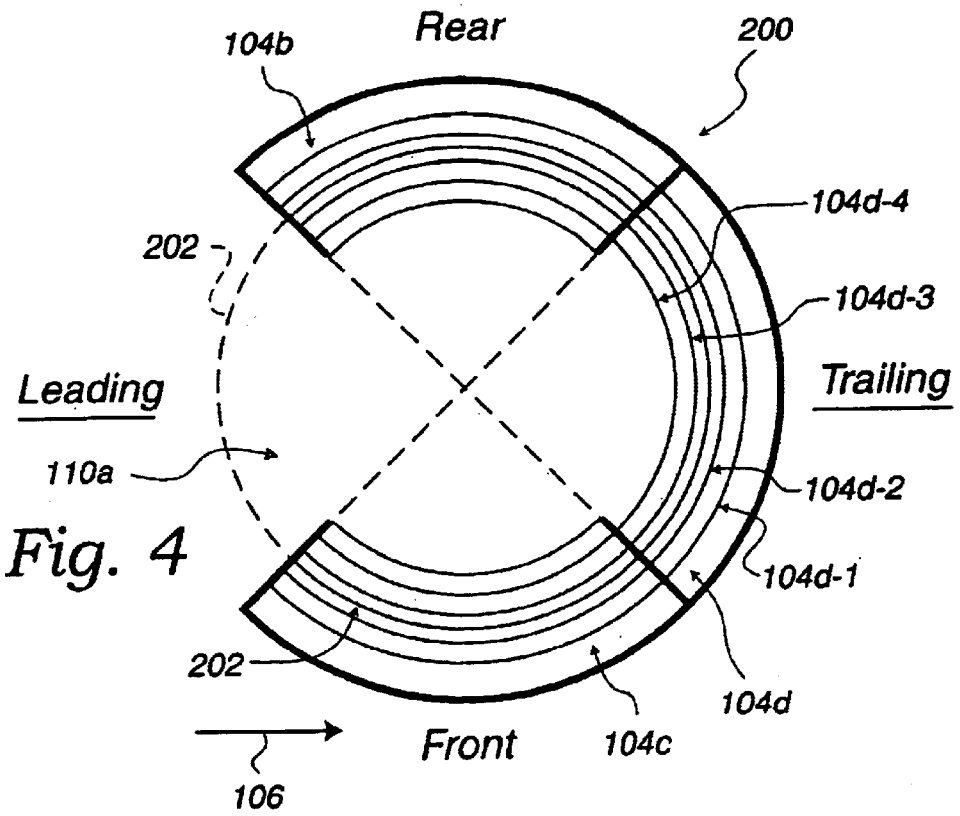
FIG. 4 is a diagram showing pressure zones generated by a fluid opening layout of the platen, in accordance with one embodiment of the present invention.

FIG. 4 is a diagram 200 showing pressure zones generated by a fluid opening layout of the platen 110, in accordance with one embodiment of the present invention. The layout includes 5 independently controllable regions of the platen 110 each comprising a plurality of fluid outputs to certain pressure zones above the platen 110. In particular, the layout 200 includes one controllable region which corresponds to both the rear zone 104*b* and the front zone 104*c* and four controllable regions which corresponds to sub zones 104*d*-1, 104*d*-2, 104*d*-3, and 104*d*-4 of the trailing zone 104*d*. A wafer edge indicator 202 is shown where a wafer edge would be located during a CMP operation.

Polishing pressure in sub zones 104*d*-3, and 104*d*-4 are generated by supplying fluid pressure from two radial rows of a plurality of fluid outputs located within the boundary of the wafer edge indicator 202. The fluid pressure is applied to the underside 102*a* of the polishing pad 102. In one embodiment each of the sub zones 104*d*-3 and 104*d*-4 are supplied polishing pressure by fluids from a corresponding one of the two radial rows of a plurality of fluid outputs that are independently controlled.

Figure 5A:
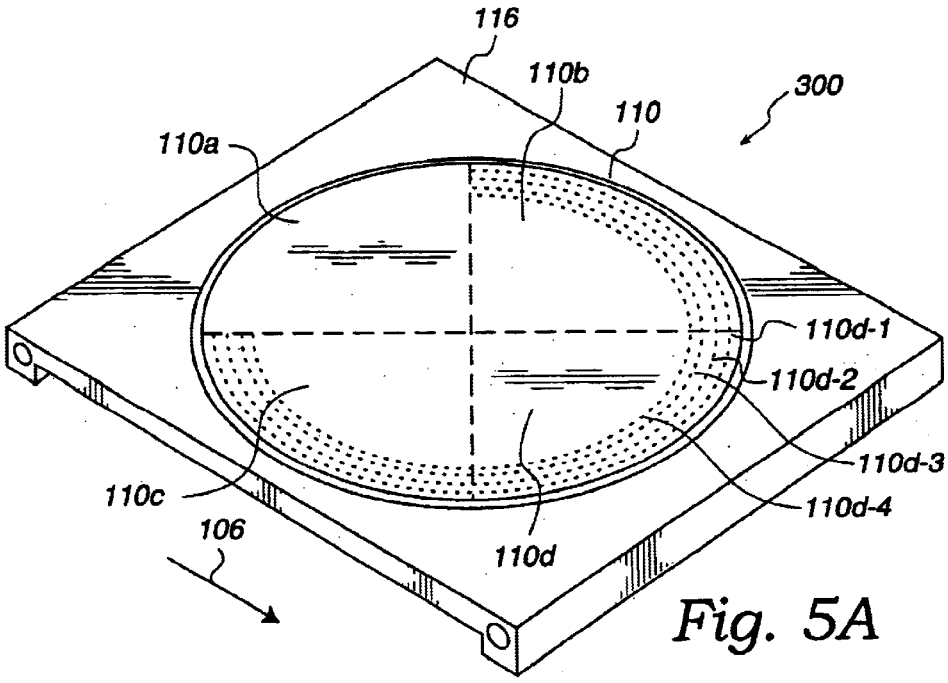
FIG. 5A is a diagram showing a fluid opening layout of the platen, in accordance with one embodiment of the present invention.

The polishing pressure in the rear zone 104*b* and the front zone 104*c* are each created by supplying fluid to the polishing pad underside 102*a* from four radial rows of a plurality of fluid outputs located in a front region and from four radial rows of a plurality of fluid outputs located in a rear region of the platen 110 (as described in further detail in reference to FIG. 5A). In one embodiment, the rear zone 104*b* and the front zone 104*c* are one controlled pressure region both having substantially the same fluid pressure at any given time. The term radial rows as utilized herein are circular rows that are concentric with all other radial rows and have a common center with the platen 110. In one embodiment, there are no fluid outputs in a center region. This again, increases fluid conservation during the CMP process.

Polishing pressure in sub zones 104*d*-1 and 104*d*-2 are generated by supplying fluid to the underside 102*a* of the polishing pad 102 from two radial rows of a plurality of fluid outputs, which are located slightly outside the boundary of the wafer edge indicator 202. In one embodiment, each of the radial rows of the plurality of fluid outputs that supply pressure to sub zones 104*d*-1 and 104*d*-2 respectively are independently controlled. Therefore, by utilizing four independently controlled sub zones 104*d*-1, 104*d*-2, 104*d*-3, 104*d*-4 of the trailing zone 104*d* and one independently controlled side zone including the rear zone 104*b* and the front zone 104*c*, five independently controlled pressures zones may provide a significant planarization improvement while polishing in the area of pad deformities.

The fluid opening layout does not have any plurality of fluid outputs supplying fluid pressure to the leading zone 104*a*. By not applying fluid pressure to the leading zone 104 and by managing fluid pressure from the other zones, polishing, especially at the wafer's edge, may be made more uniform while at the same time conserving (or restricting) usage of fluid during CMP operations. By utilizing a fluid conservation region (a region of a platen with no fluid outputs) on the leading edge region of the platen, the fluid savings during a typical CMP operation may be about 20%. It should be appreciated that depending on the polishing profile desired, the fluid savings may be less or more. Therefore there may be optimal fluid consumption savings while at the same time enhancing the uniformity of wafer edge polishing.

FIG. 5A is a diagram showing a fluid opening layout 300 of the platen 110, in accordance with one embodiment of the present invention. The platen 110 is supported by a platen surround plate 116. As shown in FIG. 2, the polishing 102 would move in a direction 106 over the platen 110. The platen 110 also has 4 major platen regions. The 4 platen regions are a fluid conservation region 110*a*, a rear region 110*b*, a front region 110*c*, and a trailing region 110*d*. The configuration of a platen that has the fluid conservation region without fluid outputs along with other platen regions having fluid outputs may be an example of an asymmetric pattern. The regions 110*b*, 110*c*, and 110*d* may use fluid pressure to apply polishing pressures to the zones 104*b*, 104*c*, and 104*d* (as shown in FIG. 4) respectively. This occurs by use of fluid pressure (generated by fluid output) from the platen 110 applied to the underside 102*a* of the polishing pad 102 (as shown in FIG. 2). The fluid conservation region 110*a* does not have any fluid openings and does not apply any fluid pressure to the leading zone 104*a*. Therefore, through utilization of the fluid conservation region 110*a* that is non-perforated, pressurized fluids are not outputted from a leading edge region of the platen thereby conserving fluids during a CMP process. The leading edge region is the region of the platen which encounters the polishing pad first when the polishing pad is rotating during the CMP process.

The rear region 110*b* includes four radial rows of a plurality of fluid outputs to control fluid pressure above a region of the platen 110 corresponding to the rear zone 104*b*. As described above, the fluid pressure applied to the underside 102*a* of the polishing pad 102 creates fluid generated polishing pressure on the wafer 104. The front region 110*c* includes include four radial rows of a plurality of fluid outputs which control polishing pressure above a region of the platen 110 corresponding to the front zone 104*c*. In one embodiment, regions 110*b* and 110*c* are linked together, utilizing a single control mechanism, or in another embodiment, the regions 110*b* and 110*c* can be implemented for separate individual control. In one embodiment, each of the separately controllable regions such as the regions 110*b*, 110*c*, and 110*d* may be designed to communicate independent fluid flows through the separately controllable regions to an underside of the linear polishing pad to intelligently control polishing pressure. In a further embodiment, the trailing region 110*d* may be independently controlled and designed to output a controlled fluid flow independently from each of the four radial plurality of output holes in the trailing zone.

In one embodiment, the fluid conservation region 110*a* is a leading edge portion of the platen 110 that does not include any fluid outputs. Advantageously, applying controlled pressure in areas other than the fluid conservation region 110*a* can both enable uniform polishing of the wafer 104 and significantly reduce fluid consumption because no fluid is outputted by the fluid conservation region 110*a*. Therefore, a significant planarization improvement, efficiency and cost effectiveness may be obtained by use of the platen 110 in a CMP system.

In one embodiment, the trailing region 110*d* is a trailing edge portion of the platen 110 that includes four sub regions each containing a plurality of fluid outputs. Sub regions 110*d*-1 and 110*d*-2 each comprise a radial row of a plurality of fluid outputs to control polishing pressure above a region of the platen 110 corresponding to the sub zone 104*d*-1 and the sub zone 104*d*-2 respectively which are located outside the wafer edge indicator 202 (as shown on FIG. 4). In addition, sub regions 110*d*-3 and 110*d*-4 each comprise a radial row of a plurality of fluid outputs to control polishing pressure above a region of the platen 110 corresponding to the sub zone 104*d*-3 and the sub zone 104*d*-4 which are located inside the wafer edge indicator 202. Each of the four radial rows of fluid outputs of the region 110*d* may be independently controlled to provide separate (or the same) levels of fluid outputs.

The platen 110 also does not have fluid outputs in a center region. In one embodiment, the center region includes a circular area inside of the fluid outputs in sub region 110*d*-4 and the fluid outputs in the platen regions 110*b* and 110*c*. Such a configuration enables further reduction in fluid use during a CMP operation. Consequently, embodiments of the present invention may enable uniform wafer polishing as well as a reduction fluid usage during CMP operations.

Figure 5B:
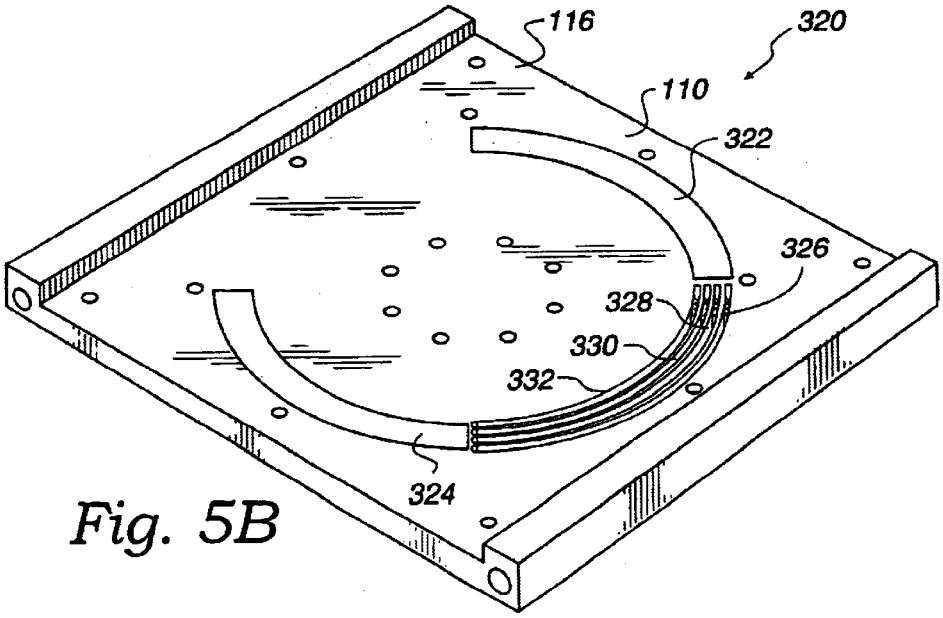
FIG. 5B shows a backside view of the platen in accordance with one embodiment of the present invention.

FIG. 5B shows a backside view 320 of the platen 110 in accordance with one embodiment of the present invention. In this embodiment, openings leading to the plurality of fluid outputs in the regions 110*b*, 110*c*, and 110*d* (as shown in FIG. 5A) can be seen. Openings 326, 328, 330, and 332, lead to a plurality of outputs in the sub regions 110*d*-1, 110*d*-2, 110*d*-3, and 110*d*-4 respectively. Fluid input to each of the openings 326, 328, 330, and 332, may be individually controlled so the sub regions containing the plurality of fluid outputs on the trailing region 110*d* may be managed to reduce polishing pressure differences between different parts of the wafer. Also openings 322 and 324 lead to a plurality of outputs in the regions 110*b* and 110*c* respectively. In one embodiment, the openings 322 and 324 receive a same pressure of fluid from the fluid supply 114 (as shown in FIG. 2) and therefore is one pressure zone. In another embodiment, fluid pressure to the openings 322 and 324 may each be independently controlled to produce two pressure zones above the platen 110.

Figure 6:
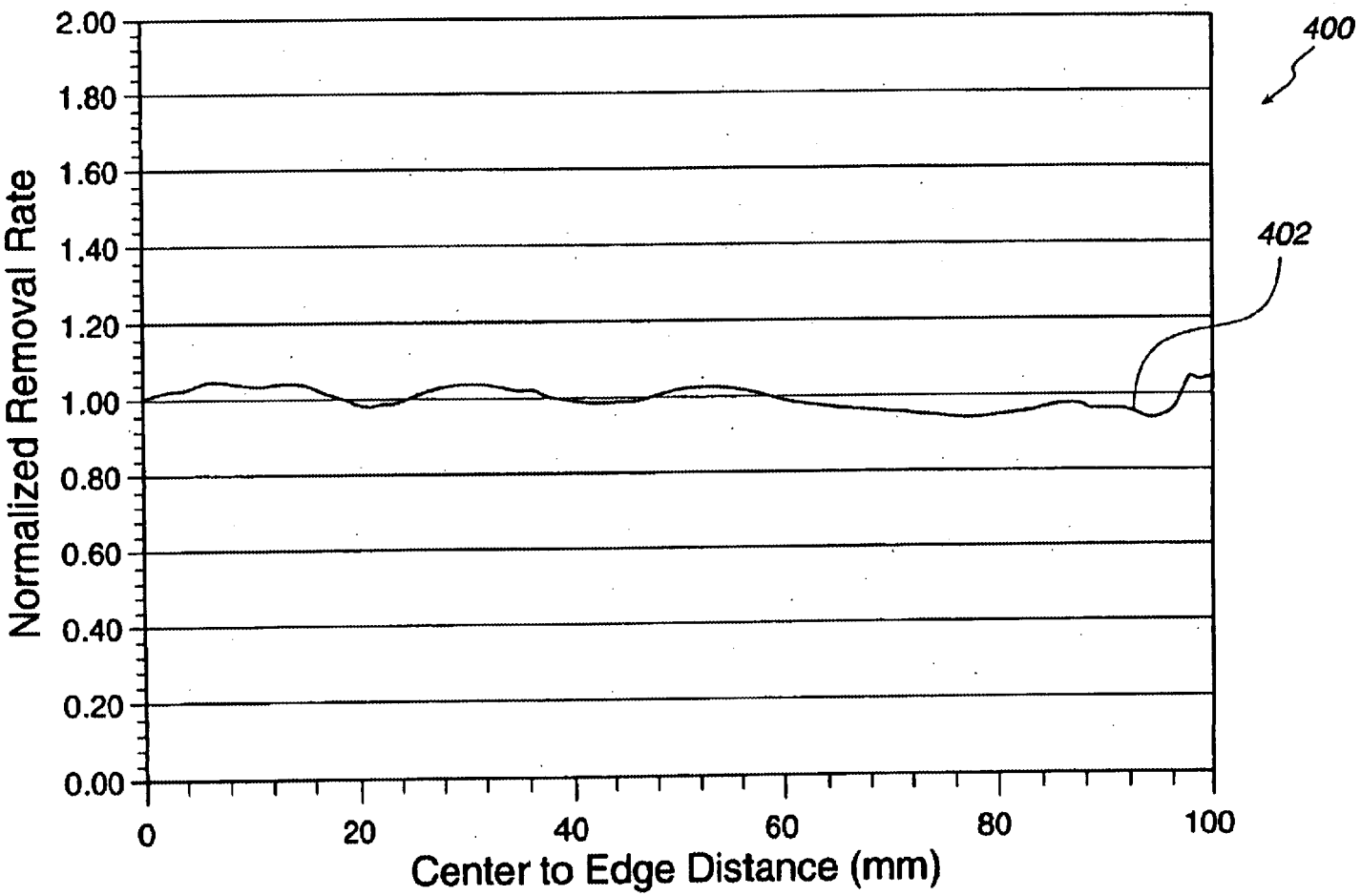
FIG. 6 shows a graph illustrating a polishing profile of a wafer in accordance with one embodiment of the present invention.

FIG. 6 shows a graph 400 illustrating a polishing profile of a wafer in accordance with one embodiment of the present invention. The graph 400 has a y-axis showing normalized removal rate and an x-axis representing center to edge distance of the wafer. The graph 400 depicts the polishing profile where a 200 mm wafer is polished. In prior art platens, difficulties arose especially in the wafer area between 80 mm and 100 mm from the center of the wafer.

In those areas, polishing rates of prior art platens generally varied widely. The line 402 illustrates a polishing profile when one embodiment of the methods and apparatus described herein is utilized. The line 402 shows that an enhanced polishing profile may be attained where wafer edge removal rates are substantially uniform from the center of the wafer to the edge of the wafer.

The line 402 was obtained in conditions where no air pressure was applied to the leading zone 104*a,* 20 PSI of air pressure was applied to the rear zone 104*b* and the front zone 104*c,* 40 PSI of air pressure was applied to the sub zone 104*d*-1, 10 PSI of air pressure was applied to the sub zone 104*d*-2, 40 PSI of air pressure was applied to the sub zone 104*d*-3, and 40 PSI of air pressure was applied to the sub zone 104*d*-4. Additionally, the downforce of the carrier head (as shown in FIG. 2) used was 3 psi, the polishing pad was a polymeric polishing belt, the belt speed utilized was 400 fpm (feet per minute), the slurry flow was 300 ml, and the time of polishing was 90 seconds.

Therefore, as shown by the diagram 400, the polishing rate is substantially uniform throughout different regions of the wafer leading to substantially optimized wafer planarization processes. Therefore, use of the platen described herein leads to improved wafer production efficiency and lower wafer production costs.

It should be appreciated that the above conditions are only exemplary in nature and other polishing conditions may be used with the apparatus described herein to obtain an optimized polishing profile while reducing fluid usage.

It should be understood that any type of fluid may be utilized in the present invention to adjust pressure on the polishing pad from the platen 110 such as, for example, gas, liquid, and the like. Such fluids may be utilized in the present invention to equalize polishing pressure on a wafer. Therefore, by use of any type of fluid compound, the plate structure may control individual outputs into certain regions of the platen 110.

It should also be appreciated any suitable type of polishing pad may be effectively utilized with platen described herein including, polymeric polishing belts, stainless steel supported polishing belts, multilayer supported polishing belts, etc. Therefore, the asymmetric platen can enhance wafer polishing uniformity in a wide variety of CMP systems.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A platen for use in a chemical mechanical planarization (CMP) system, comprising:

a front region having a plurality of fluid outlets, the front region being disposed below a polishing pad during a CUT operation, the front region being capable of providing polishing pressure to the polishing pad at a front polishing zone;

a trailing region having a plurality of fluid outlets adjacent to the front region, the trailing region being disposed below the polishing pad during the CMP operation, the trailing region being capable of providing polishing pressure to the polishing pad at a trailing polishing zone;

a rear region having a plurality of fluid outlets adjacent to the trailing region, the rear region being disposed below the polishing pad during the CMP operation, the rear region being capable of providing polishing pressure to the polishing pad at a rear polishing zone; and a fluid conservation region adjacent to the front region and the rear region, the fluid conservation region having an outletless surface that extends out from an approximate center of the platen to an outer periphery of the platen, wherein the platen is limited to supplying fluid from the plurality of fluid outlets of the front region, the rear region, and the trailing region to an underside of the polishing pad disposed above the platen to achieve a substantially uniform wafer polishing rate.

2. A platen for use in a chemical mechanical planarization (CMP) system as recited in claim 1, wherein the fluid is one of a gas and a liquid.

3. A platen for use in a chemical mechanical planarization (CMP) system as recited in claim 2, wherein the gas is clean dry air.

4. A platen for use in a chemical mechanical planarization (CMP) system as recited in claim 1, wherein the fluid conservation region reduces fluid pressure by not producing a fluid output.

5. A platen for use in a chemical mechanical planarization (CMP) system, as recited in claim 4, wherein the fluid conservation region is a non-perforated region.

6. A platen for use in a chemical mechanical planarization (CMP) system as recited in claim 1, wherein the trailing pressure region includes four independently controlled sub regions to provide independent levels of fluid output.

7. A platen for use in a chemical mechanical planarization (CMP) system as recited in claim 6, wherein each sub region includes a radial row of fluid outputs.

8. A platen as recited in claim 1, wherein a plurality of sub independently controlled regions of the trailing region is capable of supplying polishing pressure to a plurality of corresponding sub zones of a trailing polishing zone above the platen.

9. A platen as recited in claim 1, wherein the fluid conservation region is located in a leading edge region of the platen having a first contact with the polishing pad during the CMP operation.

10. A method for wafer planarization using a linear chemical mechanical planarization (CMP) system, comprising:

applying fluid from at least one fluid outlet of a first region, at least one fluid outlet of a second region adjacent to the first region, and at least one fluid outlet of a third region adjacent to the second region of the platen to an underside of a polishing pad to apply polishing pressure to at least one of a corresponding polishing zone; and restricting fluid output during wafer planarization by using a fluid conservation region that extends out from an approximate center of the platen to an outer periphery of the platen, the fluid conservation region being incapable of outputting fluids to define an asymmetric fluid output from the platen wherein the polishing pressure to the at least one of a corresponding polishing zone induces a substantially uniform wafer polishing rate.

11. A method for improved wafer planarization as recited in claim 10, wherein the trailing region has four sub regions of the platen and the trailing polishing zone has four sub zones above the platen.

12. A method for improved wafer planarization as recited in claim 11, wherein each of the four sub zones include a radial row of fluid outputs.

13. A method for improved wafer planarization as recited in claim 10, wherein the fluid is one of a liquid and a gas.

14. A method for improved wafer planarization as recited in claim 13, wherein the gas is clean dry air.

15. A method for improved wafer planarization as recited in claim 10, wherein applying fluid includes applying fluid from the front region, the rear region, and the trailing region.

16. A method for improved wafer planarization as recited in claim 10, wherein the at least one of a corresponding polishing zone includes a front polishing zone, a rear polishing zone, and a trailing polishing zone.

17. A method for improved wafer planarization as recited in claim 16, wherein the front region applies polishing pressure to the front polishing zone, the rear region applies polishing pressure to the rear polishing zone, and the trailing region applies polishing pressure to the trailing polishing zone.

18. A platen, comprising:

a support surface for supporting a portion of a linear polishing belt during a chemical mechanical polishing (CMP) operation;

a region of the support surface having no fluid outlets, wherein the region extends out from an approximate center of the platen to an outer periphery of the platen; and a plurality of fluid outlets oriented throughout the support surface, the orientation defining an asymmetric pattern, each of the plurality of fluid outlets capable of outputting a controlled fluid toward an underside of the linear polishing belt.

19. A platen as recited in claim 18, wherein the asymmetric pattern includes a front region, a rear region, a trailing region, and a fluid conservation region.

20. A platen as recited in claim 18, wherein the asymmetric pattern restricts fluid output from at least one region of the support surface by having no fluid outputs.

21. A platen as recited in claim 18, wherein the trailing region includes 4 subregions where fluid output may be independently controlled.

* * * * *